US006453789B2

(12) United States Patent
Bettger

(10) Patent No.: US 6,453,789 B2
(45) Date of Patent: Sep. 24, 2002

(54) DRIVE FOR BRAIDING MACHINE

(76) Inventor: John Leon Bettger, 1400 Thornblade Blvd. Villa #1, Greer, SC (US) 29650

( * ) Notice: Subject to any disclaimer, the term of this patent is extended or adjusted under 35 U.S.C. 154(b) by 0 days.

(21) Appl. No.: 09/737,045

(22) Filed: Dec. 14, 2000

Related U.S. Application Data

(63) Continuation-in-part of application No. 09/540,085, filed on Mar. 31, 2000.

(51) Int. Cl.[7] ..... D04C 3/00
(52) U.S. Cl. ..... 87/33; 87/41; 87/43
(58) Field of Search ..... 87/8, 9, 10, 11, 87/16, 17, 18, 19, 20, 21, 22, 31, 32, 33, 34, 35, 36, 37, 38, 39, 40, 41, 42, 43, 44, 45, 46, 47, 48, 49, 50, 51

(56) References Cited

U.S. PATENT DOCUMENTS 4,266,461 A 5/1981 Molitors ..... 87/29
4,716,807 A 1/1988 Fischer ..... 87/20
5,417,138 A 5/1995 Morris, Jr. et al. ..... 87/31
5,566,604 A * 10/1996 Sperling et al. ..... 87/31

* cited by examiner

*Primary Examiner*—John J. Calvert
*Assistant Examiner*—Shaun R Hurley
(74) *Attorney, Agent, or Firm*—McNair Law Firm, P.A.

(57) ABSTRACT

In a braiding machine having a braiding assembly which comprises a plurality of yarn carriers moving about a bed to interlace the yarns to form a braided fabric, a take-up including take-off rolls engaging and drawing off the just braided fabric, and a drive for driving the braiding assembly about the bed and the take-off rolls of the take-up. The drive comprises a drive train connecting the braiding assembly and the take-up with a power source. The drive train includes a first mechanical variator, having a control knob, interposed between the braiding assembly and the power source for driving the yarn carriers about the bed, and a second variator, having control knob, connected with the power source for driving the take-off rolls of the take-up. The variators are operative to adjust the rate of rotation of the yarn carriers about the bed and the rate of rotation of the take-off rolls of the take-up to achieve a desired product at maximum machine efficiency.

6 Claims, 4 Drawing Sheets

DRIVE FOR BRAIDING MACHINE

This is a continuation in part of U.S. application Ser. No. 09/540,085 filed on Mar. 31, 2000, the disclosure of which is incorporated herewith.

BACKGROUND OF THE INVENTION

This invention relates to braiding machines with a drive system comprising a gear belt which meshes with drive gears to provide a synchronized drive and which operates with reduced friction. The invention further relates to braiding machines having direct adjustable transmission drives between the drive motor and the take-up and the bobbin drives.

The braiding machine of the invention is very adapt at manufacturing items which are normally manufactured by small operations sometimes having only one or two machines as well as large operations. Typical articles formed by the machine of the invention are shoe laces, ropes, packing tapes, and fish nets although the machine is clearly not limited to such articles.

Common round braiding machines have long been known to the industry. Normally, these machines are restricted in production due to the friction between the drive gears which act to move the yarn carriers about the circular bed. An effort to increase the speed and reduce the friction was attempted by U.S. Pat. No. 4,913,028 which substituted a belt and pulley drive for the drive gears. This drive, not being positive, could not maintain synchronous motion between the machine elements.

It is known to provide drives for varying the rate or RPMs of both the braiding assembly and the take-up of braiding machines. For inexpensive machines which are normally used in small one, two, or three machine operations this procedure comprises changing the gear ratios in the drive train. The machine must be stopped during this procedure, which is costly and time consuming. Also, it is difficult to obtain accurately very small changes.

Another known method is by electrical controls which use sensors to vary motor speeds. U.S. Pat. No. 4,266,461 to Molitors; U.S. Pat. No. 4,716,807 to Fischer; U.S. Pat. No. 5,417,138 to Morris, Jr. et al; and U.S. Pat. No. 5,566,604 to Sperling et al generally illustrate this adjustment method.

The electronic procedure is both expensive at purchase and during operation as the life of the electric drive motors is greatly reduced. These machines are generally used in large operations as they are labor saving.

The instant arrangement is both inexpensive to purchase and finds utility in small operations.

The disclosures of the above referred to patents are incorporated with the instant disclosure.

Another object of the invention is a variable speed drive for a braiding machine which is low cost.

Another object of the invention is a braiding machine in which the driven speed and the take-up speed may be adjusted during operation.

Another object of the invention is a braiding machine in which a position drive system provides the drive for the yarn carriers and the take-up.

Another object of the invention is a braiding machine in which the output speed for the yarn carriers and the speed of the take-up is individually controlled.

Another object of the invention is a braiding machine in which the yarn carriers and the take-up are driven by a single motor and two drive systems.

Another object of the invention is a braiding machine in which loop size in the braid being formed is adjustable during braiding.

Another object of the invention is a braiding machine in which the take-up and/or the yarn carriers are sequentially adjusted during machine operation.

SUMMARY OF THE INVENTION

The instant invention is directed to a braiding machine having a braiding assembly which comprises a plurality of yarn carriers moving about a bed to interlace yarns to form a braided fabric, a take-up comprising take-off rolls engaging and drawing off the just braided fabric, and a drive for driving the braiding assembly about the bed and the take-off rolls of the take-up. The drive includes a drive train connecting the braiding assembly and the take-up with a power source. The drive train includes a first mechanical variator having a control knob, interposed between the braiding assembly and the power source for driving the yarn carriers about the bed, and a second variator, having control knob, connected with the power source for driving the take-off rolls, the take-up. The first variator control knob is operative to adjust the rate at which the yarn carriers are driven about the bed during operation of the braiding machine so that a desired rate of braiding may be selected. The second variator control knob is operative to adjust the rate of rotation of said take-off rolls of the take-up thereby adjusting the rate at which the formed fabric is drawn off, which rate determines the pitch or loop size of the forced braided fabric. The first and second variators individually rotate to achieve these desired rates of rotation.

The power source comprises two electric motors directly engaged with each of the variators or the power source may include a single electric motor directly engaged with the first variator and connected the said second variator through a second drive. The second drive comprises a pair of gear pulleys of equal pitch engaged with a gear belt which causes the electric motor to drive the first and second variators at equal rates.

The invention also includes the method of adjusting the rate of braiding and take-up in a braiding machine for achieving a selected pitch for a fabric formed on the braiding machine and for obtaining the maximum production capacity for the braiding machine. The method includes activating the braiding machine to operate at a preselected speed, adjusting the rate of take-up while continuously operating the braiding machine until the desired pitch in the fabric being formed is achieved, and then simultaneously and equally adjusting the rate of take-up and the rate of braiding until the maximum effective braiding rate is achieved.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
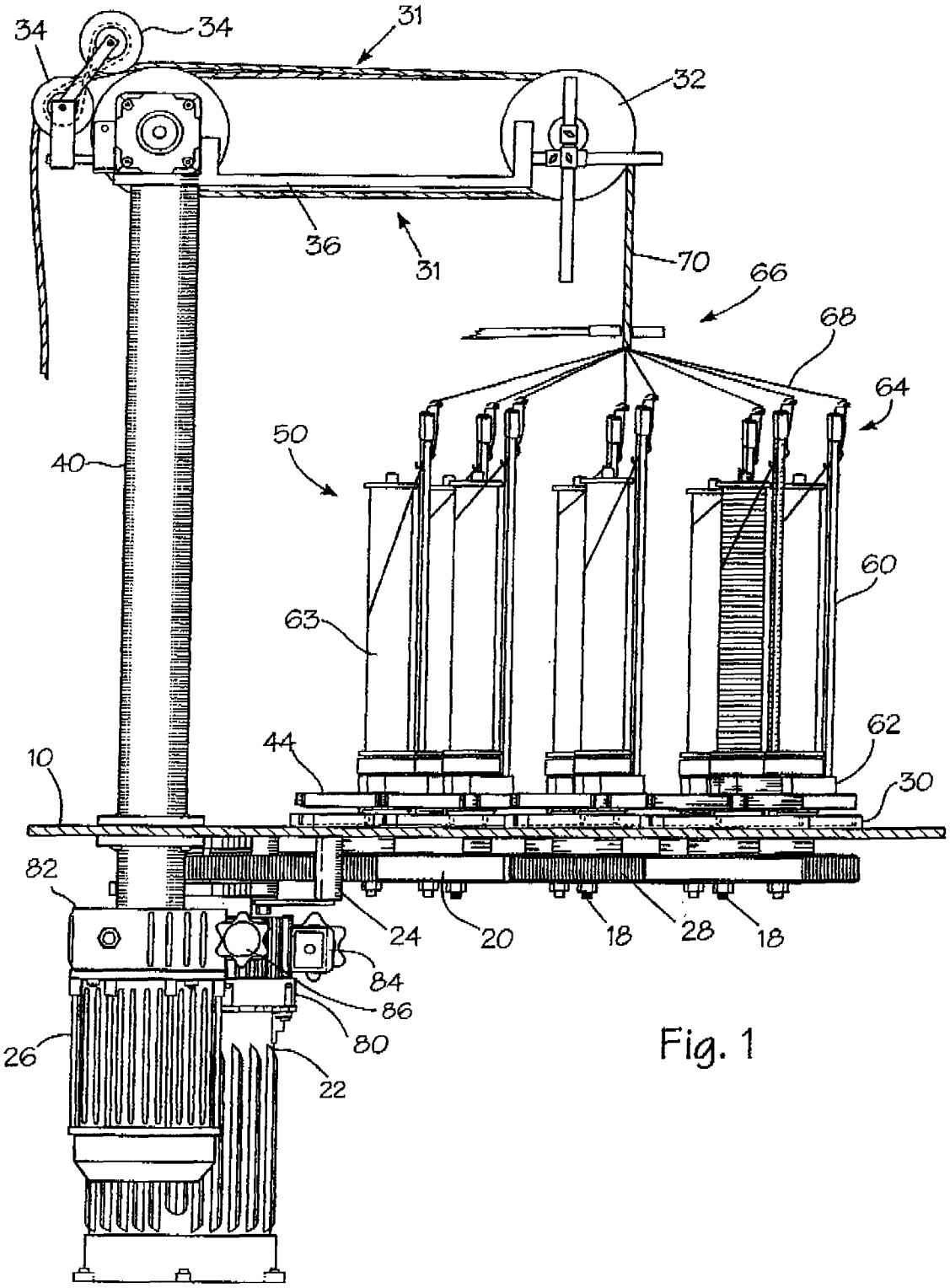
FIG. 1 is a cutaway sectional side view of a first arrangement of the braiding machine of the invention.

FIG. 1 shows the braiding machine according to the invention. The arrangement includes a support table 10 having a mounting surface which includes support or upper face and a lower face. Mounting table 10 has a plurality of through holes arranged in a circular pattern of desired size. A shaft 18 passes through each hole and is rotably mounted in a bearing. The lower end of each shaft 18 has a gear 20 secured thereto.

A drive motor 22 is secured to lower face 14 of the support table adjacent the outer periphery of the arrangement of gears 20. A drive train including a gear belt 28 is arranged to selectively intermesh with opposing sides of gears 20. A tensioning arrangement 24 of known construction is provided to maintain gear belt 28 under proper tension. A separate drive motor 26 may be provided to drive the fabric take up which includes a drive shaft connected with a drive train which drives take-up rolls at a desired speed.

Gear belt 28 is formed with teeth on each side thereof. The gear belt is arranged to engage with opposite sides of adjacent gears 20. Teeth of the gear belt are sized to mesh with the teeth of gears 20 to insure that a positive and synchronous motion is delivered from motor 22 to each shaft 18. By arranging gear belt 28 in the manner described, gears 20 are driven in opposing drive directions.

Figure 2:
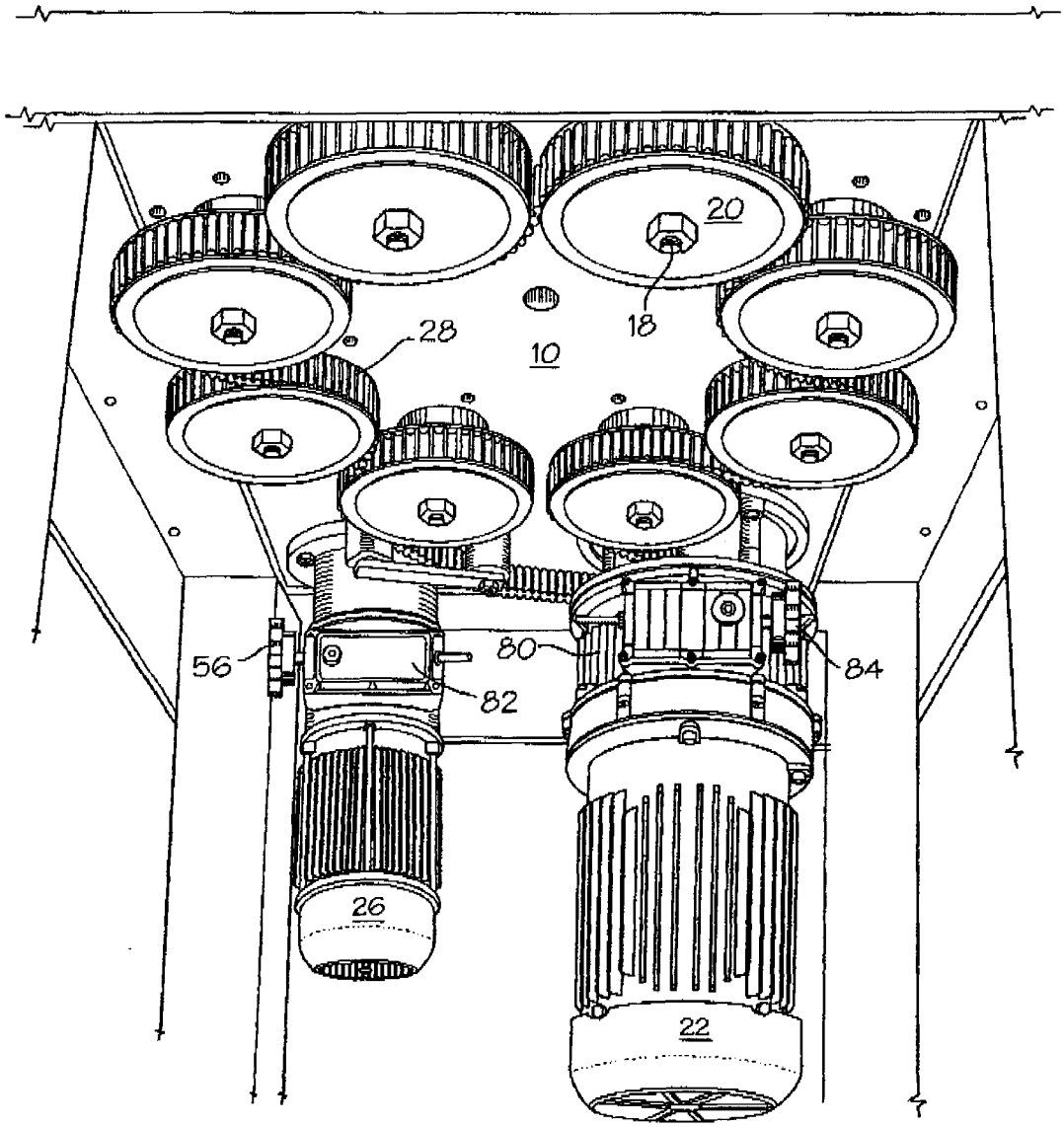
FIG. 2 is an enlarged sectional perspective view of the drive mechanism for the braiding mechanism of FIG. 1.
Figure 4:
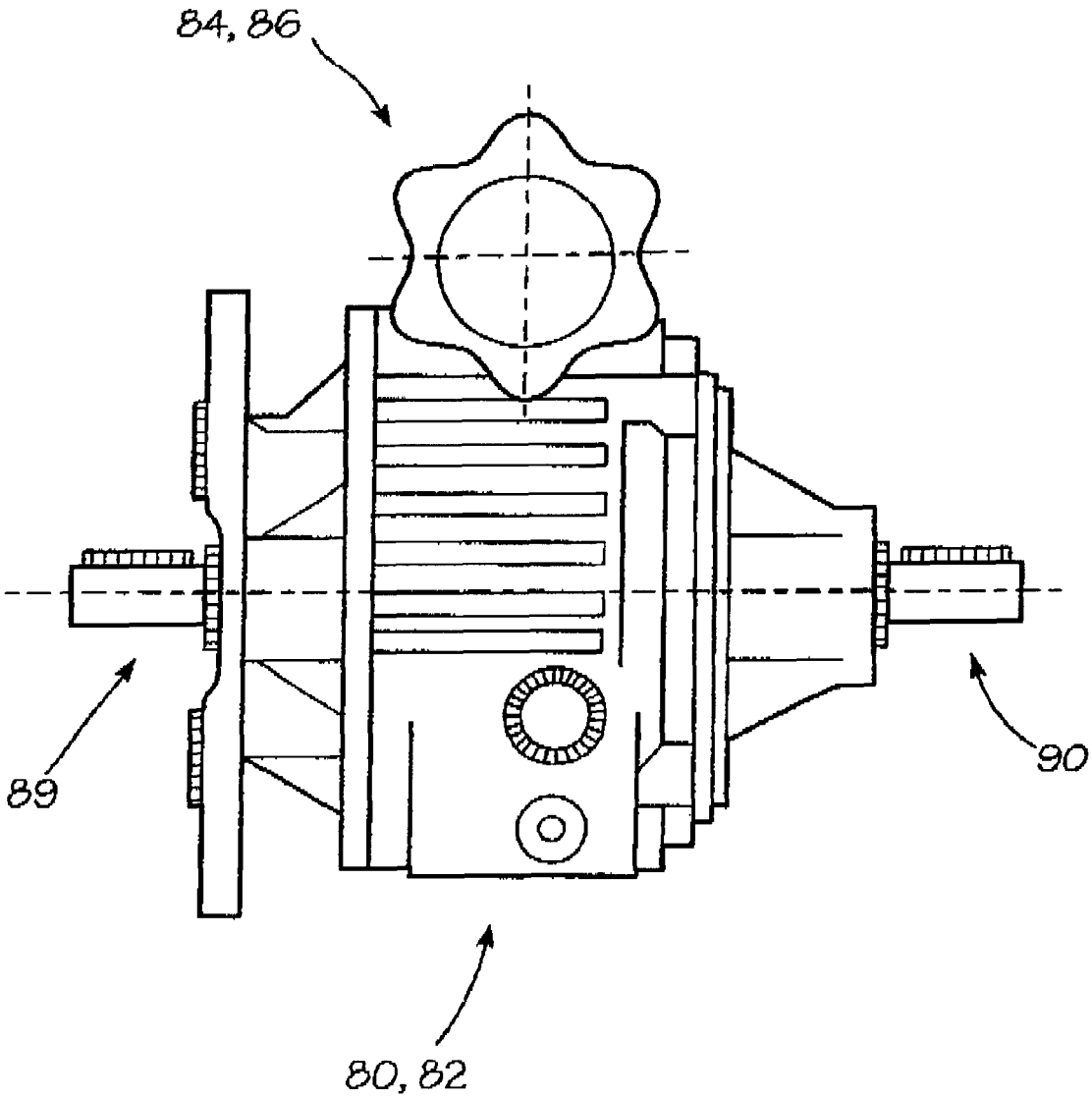

Turning now to FIGS. 1 and 4, the drive train includes variator 82 with an output shaft 89 connected with the drive of take-up 31 and an input shaft 90 connected with drive motor 26. Speed control knob 86 extends from the periphery of the variator. Connected with the input shaft 90 of the variator in the arrangement shown in FIGS. 1 and 2 is take-up motor 26.

In operation motor 26 drives the input shaft which in turn drives the output shaft of variator 82. The output shaft drives the drive take-up arrangement to be described which drives rolls 32, 33 at RPMs within a selected and prescribed range.

Variators, such as variator 82, are a commercial item and are manufactured by various companies such as Bongifiloli Riduttori S.p.a. of Bologna, Italy. The variator structure itself forms no part of the instant invention.

Mounted with the underside of table 10 and adjacent to variator 82 and included in the drive train is a second and substantially identical variator 80. Variator 80 has its output 89 connected with the drive gear for belt 28. The input shaft 90 of variator 80 is connected with the drive shaft of motor 22 which drive belt 28 and gears 21 within a prescribed and selected range of RPMs. Variator 80 also has an adjustment knob 84 projecting from its periphery.

Control knobs 84 or 86 when rotated to the right alter the output speed of the output shaft of the associated variator in a first direction and when rotated to the left alter the speed of rotation of the associated output shaft in the opposite direction.

As shown, variator 82 is larger than variator 84 because of differences in the power range requirements. However, the range of variation in both is exactly the same so that if the input of each variator is the same and the control knob settings are the same, the output in RPMs of each will be the same. The preferred range for variators 80, 82 is 6:1, however, this could vary in either direction.

Secured with the mounting surface or top of table 10 are a plurality of segments 30. Each segment 30, which is substantially circular in shape, is formed with a plurality of mounting holes and a center bore including bearing surface. Segments 30 are secured in fixed position with mounting surface of table 10, by way of bolts forming the bed of the braiding machine. This structure is described in more detail in the earlier filed application Ser. No. 09/540,085.

A shaft 18 extends through each opening and mounts a drive dog 44 in vertically spaced position form segments 30. Each drive dog includes a plurality of opposed recesses or notches about its periphery. There are preferable four notches or recesses formed in each drive dog. This number could be varied to be more or less if desired.

Yarn carriers 50, which carry yarn supply bobbins 63 and comprise the braiding assembly, move about the ring of circles of the bed of segments and the plurality of drive dogs 44. A base 62 carries spindle 56 and ring follower 48. Bobbins 63 are carried by spindles 56. Followers 48 are driven by drive dogs 44 about the bed.

Each base 62 is of substantially rectangular shape with planer upper and lower surface. Risers 60 are positioned adjacent a first edge while bobbins 63 are positioned toward the opposite edge of the base at a distance to allow clearance for rotation.

It is important to note that the instant structure lowers significantly the height of the yarn carrier, thus lowering its center of gravity. By arranging yarn carrier 50 in close proximity with the top of table 10 and in contact with drive dogs 44, they may be driven at higher speeds as they tend to travel about the tracking groove with less friction and vibration, thus allowing the machine to operate at higher speeds.

A yarn tensioning and control 64 is mounted on risers 60. The tension and control includes upper and lower slides and yarn guides arranged as earlier described.

In practice each yarn 68 is drawn from bobbin 63, passes along an undulating path through tensioning and control 64 over and under other yarns to gathering section 66 where it is formed into a braided fabric.

The braiding assembly includes a plurality of yarn carriers 50, usually two per drive dog 44, are mounted on the braiding machine. Yarn 68 from each bobbin is drawn through the associated guide 64, interlaced into a braided fabric 70 at gathering section 66, and moves onto take-up 31. Each yarn carrier 50 is connected with a drive dog 44 through the engagement of a follower with drive dog 44. Tracking pawls, which extend from the lower surface of base 62, are engaged in the camway and act to stabilize the yarn carrier as it is moved about the ring of circles formed by each segment of the camways. This movement causes yarn carriers 50 to pass from a first side of one segment to the opposite side of an adjacent segment as they are moved about the bed of the braiding machine. Alternate yarn carriers move in opposite directions about the bed and are driven about opposite sides of the segment loops of adjacent segments. This motion brings about braiding, which is a plaiting of textile strands, at gathering section 66.

As braided fabric is drawn off by take-up 31 from gathering point 66 it is moved past guide rollers 34 into a storage area not shown.

Take-up 31 includes a pair of take-off rolls 32, 33 which are carried by suitable means on platform 36 which is secured with post 40. A drive shaft extends through post 40 to connect by way of suitable gearing associated with roll 33 and with the output from the take-up drive. This arrangement, so far described, is common and need not be further discussed.

Turning again to FIG. 1, start-up will now be described. With the machine and yarns as shown, motors 22, 26 are activated causing yarn carriers 50 to move about the ring of circles causing bobbins 63 to rotate as they are carried about the bed. Yarns 68 are interlaced as they are drawn from the bobbins and are formed into a braided fabric 70 at gathering point 66. Motor 26 drives take-up 31 at a selected speed, which speed is set relative to the speed of carriers 50 and which speed determines the tightness of the braid. With carriers 50 moving at a fixed rate, a slower speed for take-up 31 produces large loose loops and an unstable braided fabric while a faster speed produces smaller, tighter loops and a more stable fabric. The loop size is referred to as the pitch which is how a braided fabric is designated. In practice once the desired loop configuration and tightness or pitch is achieved by individually rotating control knobs 84, 86. Once the desired ratio is achieved, the control knobs are then rotated in unison to achieve the highest efficient speed for the desired fabric.

Figure 3:
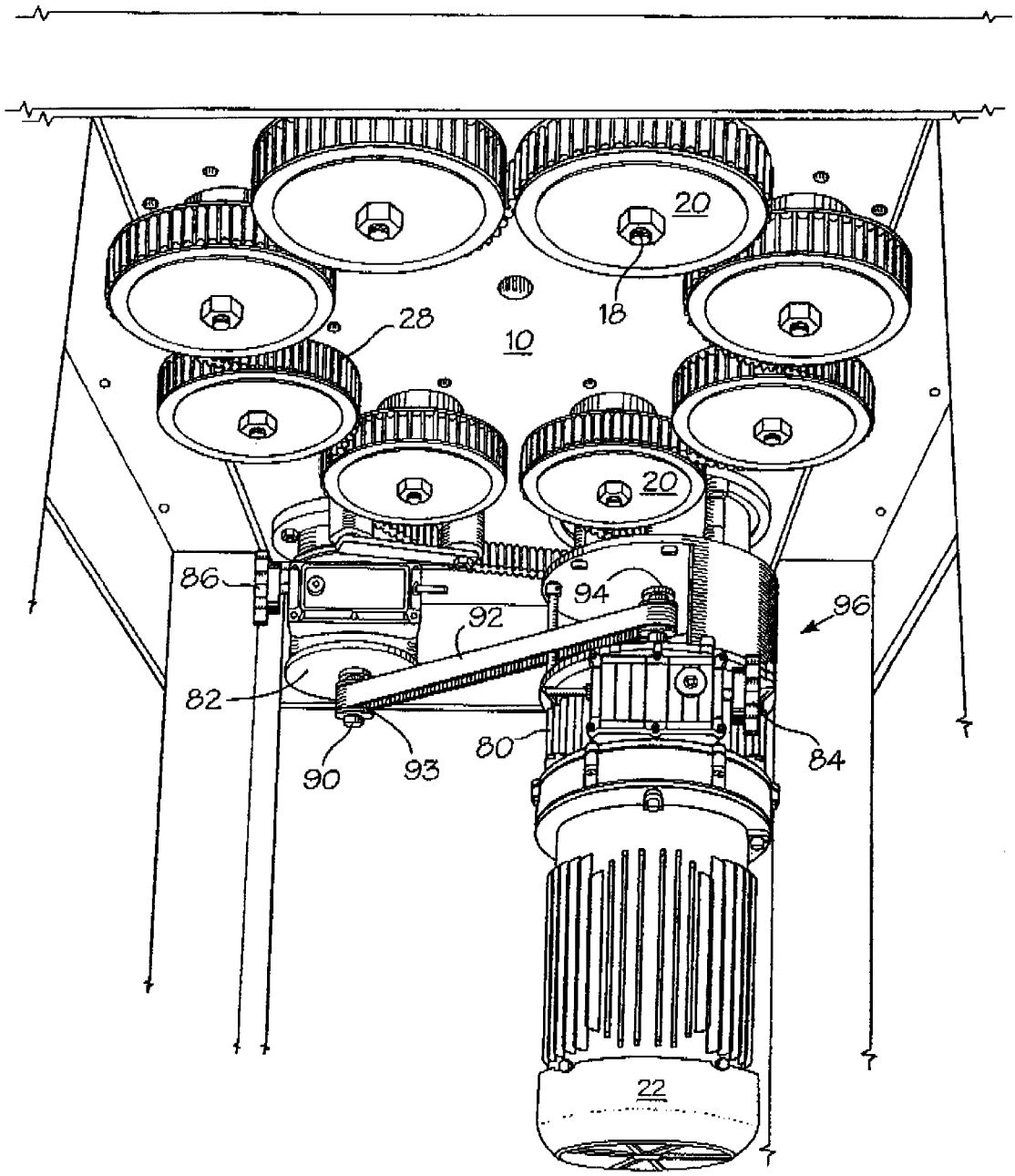
FIG. 3 is an enlarged sectional perspective view of a second arrangement of the drive mechanism for the braiding mechanism of FIG. 1; and, FIG. 4 is a side view of a variator.

In a second arrangement as shown in FIG. 3, take-up motor 26 is eliminated and a gear pulley 93 is fixed with input shaft 90 of variator 82. A spacer 96 is installed between the drive gear for belt gear 28 and variator 80 and a gear pulley 94 is fixed with the output shaft. A gear belt 92, similar to gear belt 28, is engaged with equal size gear pulleys 93, 94 providing a positive drive between the output of variator 80 and the input for variator 82.

The braiding structure above table 10 remains as shown in FIG. 1.

The mode of operation is as follows. Motor 22 is actuated to drive take-up 31 by way of gear belt 92 and the braiding assembly in the manner previously described. Again, control knob 86 is rotated until the desired relationship between the braiding speed and the take-up speed is achieved. Now only control knob 84 need be adjusted because the relative speed between take-up 31 and the braiding assembly is fixed by gear belt 92 and gear pulleys 93, 94.

The described braiding machine is inexpensive, is of simple construction and is, therefore, easy to maintain and operate. It is trouble free and operates efficiently at high speed. It is efficient for large plant operations or for individual owner operations of one or two machines.

While a preferred embodiment of the invention has been described using specific terms, such description is for illustrative purposes only, and it is to be understood that changes and variations may be made without departing from the spirit or scope of the following claims.

What is claimed is:

1. A braiding machine having a braiding assembly which comprises a plurality of yarn carriers moving about a bed to interlace the yarns to form a braided fabric, a take-up comprising take-off rolls engaging and drawing off the just braided fabric, and a drive for driving said braiding assembly about said bed and said take-off rolls of said take-up, said drive comprising:

a drive train connecting said braiding assembly and said take-up with a power source;

said drive train including a first mechanical variator having a control knob interposed between said braiding assembly and said power source for driving said yarn carriers about said bed, and a second variator, having control knob, connected with said power source for driving said take-off rolls of said take-up;

said first variator control knob being operative to adjust the rate of rotation of said yarn carriers about said bed during operation of said braiding machine to select the desired rate of braiding; and, said second variator control knob being operative to adjust the rate of rotation of said take-off rolls of said take-up to draw off the formed frabric at a rate which produces the desired pitch.

2. The braiding machine of claim 1 wherein said first and second variator are manually and individually rotated to achieve said desired rates of rotation.

3. The braiding machine of claim 1 wherein said power source comprises two electrics earch directly engaged with one of said first and second variators.

4. The braiding machine of claim 1 wherein said power source includes a single electric motor directly engaged with said first variator and connected with said second variator through a second drive.

5. The braiding machine of claim 4 wherein said second drive comprises a pair of gear pulleys of equal pitch engaged with a gear belt, whereby said electric motor drives said first and second variators at equal rates.

6. The method of adjusting the rate of braiding and take-up in a braiding machine for achieving a selected pitch for a fabric formed on said braiding machine and for obtaining maximum production capacity of said braiding machine, said method including:

activating the braiding machine to operate at a preselected speed;

adjusting the rate of take-up while continuously operating the braiding machine until the desired pitch in the fabric being formed is achieved; and, simultaneously and equally adjusting the rate of take-up and rate of braiding until the maximum effective braiding rate is achieved.

* * * * *